US008587202B2

(12) United States Patent
Harmann et al.

(10) Patent No.: US 8,587,202 B2
(45) Date of Patent: Nov. 19, 2013

(54) HIGH-VOLTAGE INSULATOR ARRANGEMENT AND ION ACCELERATOR ARRANGEMENT HAVING SUCH A HIGH-VOLTAGE INSULATOR ARRANGEMENT

(75) Inventors: Hans-Peter Harmann, Lindau (DE); Norbert Koch, Ulm (DE); Guenter Kornfeld, Elchingen (DE)

(73) Assignee: Thales Electronic Systems GmbH, Ulm (DE)

( * ) Notice: Subject to any disclaimer, the term of this patent is extended or adjusted under 35 U.S.C. 154(b) by 660 days.

(21) Appl. No.: 12/733,628

(22) PCT Filed: Sep. 12, 2008

(86) PCT No.: PCT/EP2008/062142

§ 371 (c)(1),
(2), (4) Date: Nov. 29, 2010

(87) PCT Pub. No.: WO2009/037195

PCT Pub. Date: Mar. 26, 2009

(65) Prior Publication Data

US 2011/0089836 A1 Apr. 21, 2011

(30) Foreign Application Priority Data

Sep. 14, 2007 (DE) ..... 10 2007 044 070

(51) Int. Cl.
*H01J 7/24* (2006.01)

(52) U.S. Cl.
USPC ..... 315/111.91; 315/111.81; 315/111.21; 315/500

(58) Field of Classification Search
USPC ..... 315/500, 111.21, 111.91, 111.81, 108, 315/110
See application file for complete search history.

(56) References Cited

U.S. PATENT DOCUMENTS

| | | | | |
|---|---|---|---|---|
| 2,775,640 | A | 12/1956 | Steeves | |
| 5,490,910 | A | 2/1996 | Nelson et al. | |
| 6,982,520 | B1 | 1/2006 | de Grys | |
| 7,084,572 | B2 | 8/2006 | Kornfeld et al. | |
| 2003/0157000 | A1 * | 8/2003 | Janssen et al. | 422/139 |

FOREIGN PATENT DOCUMENTS

| | | |
|---|---|---|
| WO | WO 99/63223 | 12/1999 |
| WO | WO 03/000550 | 1/2003 |
| WO | WO 2007/027965 | 3/2007 |

OTHER PUBLICATIONS

International Search Report, 2008.

* cited by examiner

*Primary Examiner* — Douglas W Owens
*Assistant Examiner* — Jianzi Chen
(74) *Attorney, Agent, or Firm* — Collard & Roe, P.C.

(57) ABSTRACT

The invention relates to an ion accelerator arrangement comprising an electrostatic acceleration field between a cathode to which a frame potential is applied and an anode to which a high-voltage potential is applied. The ion accelerator arrangement further comprises a gas supply system into which a gas-permeable, open porous insulator member is introduced. Also described is a high-voltage insulator arrangement that comprises such an insulator member and is suitable, inter alia, for such an ion accelerator arrangement and for the corona-resistant insulation of other components to which a high voltage is applied.

11 Claims, 2 Drawing Sheets

Figure 1:
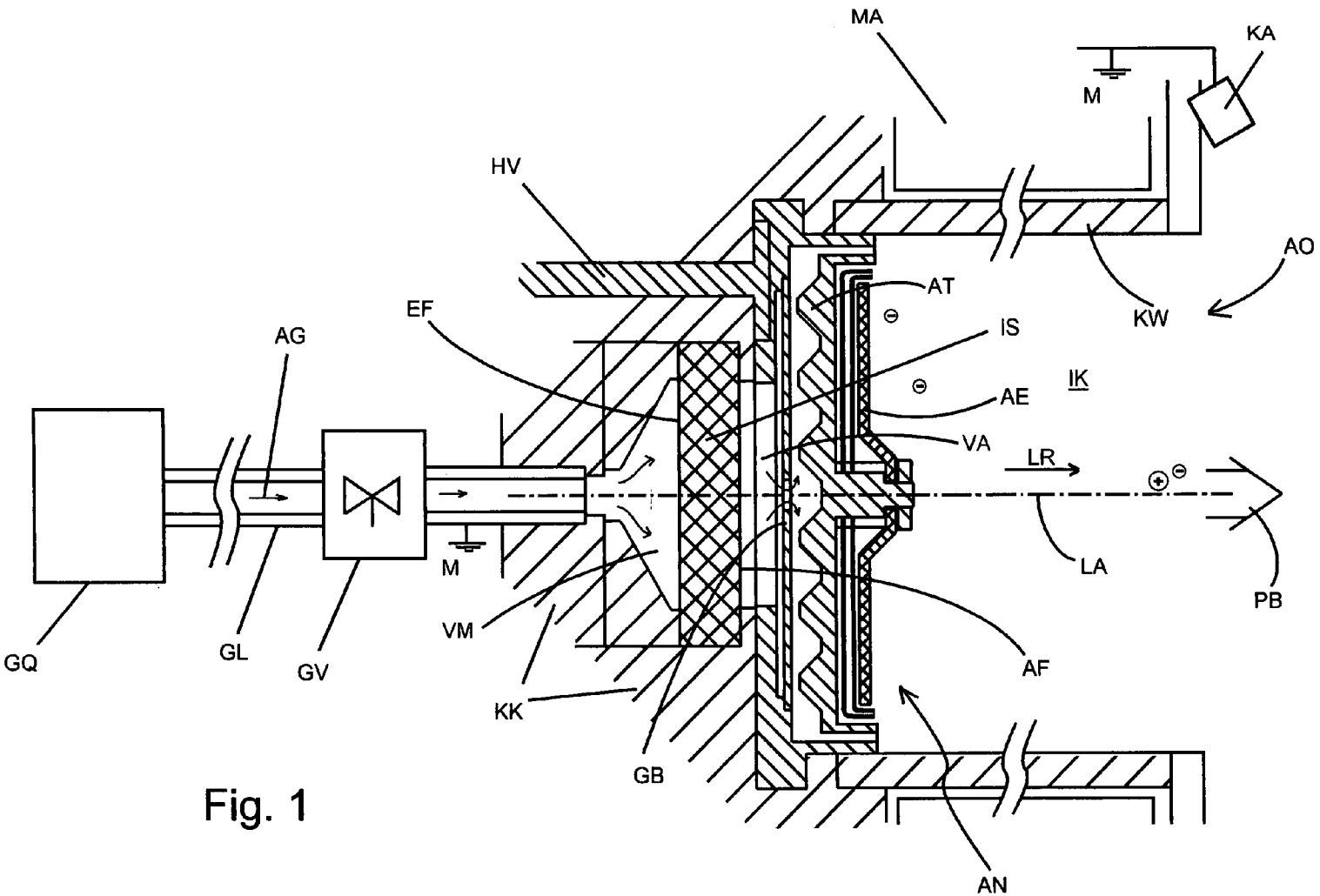

HIGH-VOLTAGE INSULATOR ARRANGEMENT AND ION ACCELERATOR ARRANGEMENT HAVING SUCH A HIGH-VOLTAGE INSULATOR ARRANGEMENT

CROSS REFERENCE TO RELATED APPLICATIONS

This application is the National Stage of PCT/EP2008/062142 filed on Sept. 12, 2008, which claims priority under 35 U.S.C. §119 of German Application No. 10 2007 044 070.9 filed on Sept. 14, 2007. The international application under PCT article 21(2) was not published in English.

The invention relates to a high-voltage insulator arrangement and to an ion accelerator arrangement having such a high-voltage insulator arrangement.

In electrostatic ion accelerator arrangements, as they are particularly known for drive of spacecraft, a working gas is ionized in an ionization chamber, and the ions are ejected through an opening in the chamber under the influence of an electrostatic field. The electrostatic field is formed between a cathode disposed outside of the ionization chamber, typically offset laterally relative to its opening, and an anode disposed at the foot of the chamber, set opposite the opening, and passes through the chamber. A high voltage lies between anode and cathode to generate the electrical field. Typically, the cathode lies at least approximately at the mass potential of the spacecraft, at which other metallic components of the spacecraft also lie, and the anode lies at an anode potential offset from mass by means of the high voltage. A particularly advantageous ion accelerator of this type is known, for example, from WO03/000550 A. Other embodiments are known as Hall thrusters.

The high voltage acts not just between anode and cathode, but also between the anode, including the high-voltage feed line, and other conductive components at a potential different from the anode potential, particularly the mass potential. While components separated by means of the vacuum of the surrounding space are generally sufficiently insulated from one another to prevent voltage flashover, there is a risk of corona discharges caused by the working gas in regions in which the working gas occurs, particularly between the anode and a conductive component situated upstream of the gas stream in the gas feed system.

Corona discharges can also occur between two conductive components that lie at potentials separated by a high voltage, in vacuum applications, in other regions and situations, whereby a voltage flashover is facilitated by gas that is present, in an intermediate-pressure range (Paschen range). Then, discharges that carry high currents can ignite in paths that are continuously open between the conductive components. A plasma that forms in the discharges is able to penetrate into even small cracks or gaps. While it is true that such regions can be made corona-resistant by lowering the gas pressure below the critical pressure range, by way of gas release openings to a surrounding vacuum, discharges in the intermediate-pressure range can occur again in regions having alternating gas pressure, which then can also pass through the gas release openings that form continuously open paths. Furthermore, even below the critical pressure range, a shunt can occur due to free electrons, which is disruptive due to distortion of current values or power consumption, or can also ignite a vacuum arc discharge.

Pressure-independent insulation between two components, particularly a component that conducts a high voltage relative to mass, can be achieved by means of enclosing a component completely, in gastight manner, so that no continuously open paths between the two components are present, for example by means of encasing or embedding a component in an insulator body, but this is eliminated for releasable line connections as a component. It has furthermore been shown that damage occurs even in such encased high-voltage insulator arrangements over an extended period of time, and this can result in serious damage, particularly when they are used in spacecraft, without the possibility of replacing components.

The present invention is based on the task of indicating a high-voltage insulator arrangement and an ion accelerator arrangement having such a high-voltage insulator arrangement with improved high-voltage insulation.

Solutions according to the invention are described in the independent claims. The dependent claims contain advantageous embodiments and further developments of the invention.

In the case of an electrostatic ion accelerator arrangement having an ionization chamber and an anode electrode disposed in the ionization chamber, and a gas feed system for introducing working gas into the ionization chamber, a pressure range of the working gas is typically present, during the introduction of the working gas, in which a corona discharge from the anode electrode as the first component, by means of the working gas, to a second conductive component that is disposed upstream in the gas feed system, i.e. in front of the ionization chamber in the flow direction of the working gas being fed in, could occur at the high voltage, in the kilovolt range, that is applied between the electrode and the mass potential during operation. By means of inserting an insulator body into the gas feed system, which body contains a gas-permeable, open-porous (open-pored) dielectric, such a corona discharge is prevented, and, at the same time, feed of working gas into the ionization chamber is made possible. Electrically conductive second components of the gas feed system, particularly metallic components, including a controllable valve that is advantageously provided there, are disposed upstream of the insulator body within the gas flow path, whereas the anode electrode and electrically conductive first components that lie in the flow path of the working gas are disposed downstream of the insulator body. In particular, the first components form the electrically conductive, particularly metallic components that lie closest to the insulator body downstream, and the second components form the conductive, particularly metallic components that lie closest to the insulator body upstream. The gas stream necessarily takes place through the gas-permeable insulator body. Secondary flow paths of the working gas, circumventing the insulator body, by way of which a high-voltage flashover would again be possible, are not provided. The gas-permeable insulator body can advantageously be inserted into one or more gas-impermeable insulating dielectric bodies, and laterally enclosed by them.

The insertion of the gas-permeable insulator body into the flow path of the gas stream particularly also makes a compact construction of the gas feed system in the ion accelerator possible, since only a slight distance between the gas feed system that lies at mass and the anode arrangement that lies at high voltage has to be maintained, with the interposition of the insulator body. Advantageously, the distance of the insulator body from conductive parts of the anode arrangement and/or the gas feed system can be less than the smallest dimension of the insulator body crosswise to the main flow direction of the working gas through the insulator body, particularly also less than the smallest dimension of the insulator body in the main flow direction of the working gas. The insulator body is preferably configured in disk shape and oriented with the disk surface crosswise to the main flow direction of the working gas. The insulator body is advantageously disposed on the side of the anode arrangement that faces away from the ionization chamber.

A high-voltage insulator arrangement having a gas-permeable, open-porous insulator body between two conductive components at potentials separated by a high voltage, as it is present, in the manner described, with particular advantage, between an electrode of an ionization chamber and a conductive component upstream from a gas feed system, is advantageous in general use in vacuum applications with high voltages and the occurrence of gas in a space between the conductive components, particularly, again, in the case of an ion accelerator arrangement as a drive in a spacecraft. In this connection, it is provided, in a general application, that two conductive components that lie at different potentials, separated by a high voltage, are insulated relative to one another by means of an insulation device, and at least a part of the insulation device is formed by a gas-permeable, open-porous insulator body. The insulation device can particularly surround one of the conductive components on all sides. Such a high-voltage insulator arrangement is of significance if gas can occur in a space between the components that are insulated from one another, through which space the electrostatic field of the high voltage passes. If specific pressure and high-voltage conditions are present, a current path, particularly a direct-current path, can occur in the gas, by way of plasma. A gas stream is possible between the first partial space on the side of the first conductive component and the second partial space on the side of the second conductive component, by way of the gas-permeable insulator body. Secondary gas flow paths, by way of which gas could flow and a direct-current path could form, circumventing the gas-permeable insulator body, are not provided.

Such a high-voltage insulator arrangement is particularly advantageous in the case of a releasable plug-in connection between a high-voltage source and an electrode that lies at high voltage, relative to mass potential, during operation of an ion accelerator, for example. The plug-in connection advantageously allows that from the separate production of a high-voltage source and one or more drive modules, to trial measures, to installation in a spacecraft, a conductor connection, particularly by way of an insulated cable, between the high-voltage source and an electrode of the drive module, can be released, again and again, and therefore the device as a whole can be handled significantly more easily than in the case of one-time insulator encasing of a conductor connection.

Furthermore, the gas-permeable, open-porous insulator body in the insulation device, as a whole, proves to be more resistant in the long term than encased or other non-gas-permeable insulation mantles of a conductive component. This is based on the recognition that conventional plastic insulation materials that are suitable for spacecraft and high-voltage applications frequently still have gas inclusions, particularly between conductor and insulation, in which micro-plasmas can occur, which can damage the insulation device to such an extent, over time, that corona discharges between conductive components can occur. By means of the gas-permeable insulator body, such gas inclusions that might be present are more easily eliminated by passing the gas out into the surrounding space.

Also in surroundings in which a gas is present around the insulation device, in an intermediate-pressure range or a high-pressure range, particularly also at changing gas pressure, the gas-permeable, porous insulator body is particularly advantageous. While it is true that when gas is pressing in an intermediate-pressure range, a plasma can ignite both within and outside of the cavity of the insulation device, a continuous direct-current path between the conductive components cannot form. If the intermediate-pressure range is departed from again, which takes place due to the gas permeability of the porous insulator body within and outside of the cavity of the insulation device, an existing plasma is extinguished, or no new one will ignite, respectively.

The gas-permeable insulator body can be formed, for example, by means of an open-pored foam or preferably by means of an open-pored ceramic material. The average pore size of the open, porous dielectric in the direction of the electrical field between the components brought about by the high voltage advantageously lies below 100 μm. The insulator body is particularly advantageous if the dimensions of the cavities in the gas-permeable insulator body are smaller than the Debye length in the direction of the electrical field built up by the high voltage. The flow paths of the gas through the insulator body are advantageously deflected relative to a straight progression between gas entry side and gas exit side. The gas-permeable insulator body can also be formed by multiple partial bodies.

Figure 2:
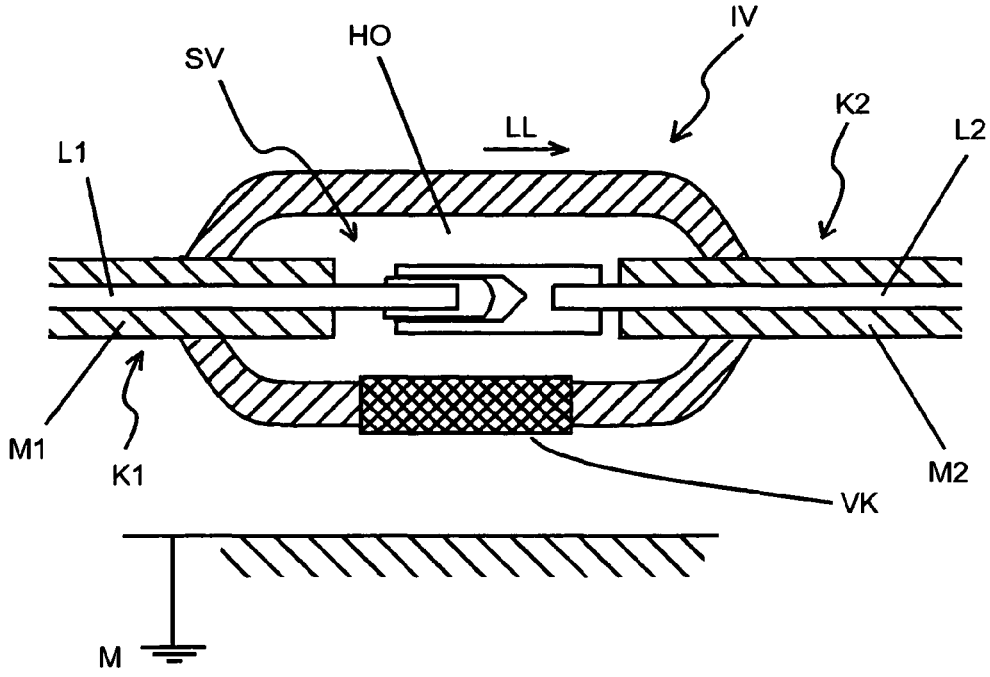
Figure 3:
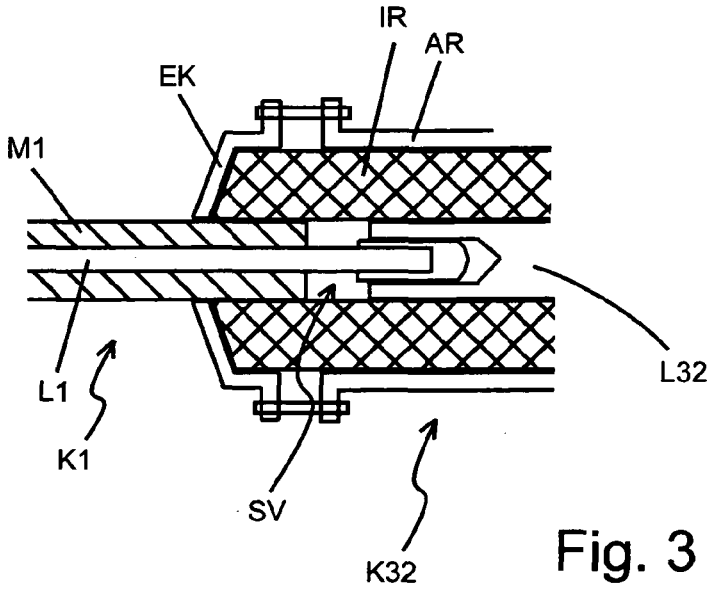

The invention will be illustrated in greater detail in the following, using preferred exemplary embodiments. In this connection, the drawing shows:

FIG. 1 a gas feed system with an insulator body,

FIG. 2 a releasable conductor connection with an insulator body,

FIG. 3 a modification of the arrangement according to FIG. 2.

In FIG. 1, a drive arrangement of an electrostatic ion accelerator for drive of a spacecraft is shown schematically. The arrangement has an ionization chamber IK, in conventional and known manner, which is open toward one side in a longitudinal direction LR, at a beam exit opening AO, and contains an anode arrangement AN at the foot point of the ionization chamber, opposite the beam exit opening AO in the longitudinal direction. The ionization chamber is laterally delimited by a chamber wall KW made of preferably dielectric, for example ceramic material, and can particularly have a ring-shaped cross-section. The anode arrangement AN consists of an anode electrode AE and an anode carrier body AT in the example shown. In the region of the beam exit opening, preferably offset laterally relative to the beam exit opening, a cathode arrangement KA is disposed. A high voltage lies between anode electrode AE and cathode arrangement KA, which generates an electrical field that points in the longitudinal direction LR in the ionization chamber, by mans of which field ions of a working gas ionized in the ionization chamber are accelerated and ejected from the chamber in the longitudinal direction, as a plasma beam PB. Typically, the cathode lies at the mass potential of the spacecraft that contains the drive arrangement, and the anode arrangement lies at a high-voltage potential HV of a high-voltage source. In the ionization chamber, a magnetic field is also present, the progression of which depends on the type of construction of the drive arrangement and contains multiple cusp structures having alternating polarity, spaced apart in the longitudinal direction, in a particularly advantageous known embodiment. The magnet arrangements that generate a magnetic field are known, for example from the state of the art mentioned initially, and are not included in FIG. 1, for the sake of clarity.

A working gas AG, for example xenon, is stored in a supply container GQ as a gas source, and passed to the ionization chamber IK by way of a gas feed line GL and a controllable valve GV, whereby in the example shown, the introduction of the working gas into the ionization chamber takes place from the side of the anode arrangement that faces away from the ionization chamber, and laterally past it, as is illustrated by the arrows that indicate the flow directions.

The gas feed line GL and other components of the gas feed system typically lie at mass potential, so that the high voltage is in effect between these components and the anode arrangement AN, as well, and the risk of corona discharges between the anode arrangement and the components that lie at mass potential M, by means of the working gas that is present in an intermediate-pressure range, exists during feed of working gas from the gas source GQ to the ionization source. The pressure range in which a gas discharge by means of a gas can ignite is understood to be the intermediate-pressure range. The intermediate-pressure range is dependent on the high voltage, among other things.

A gas-permeable insulator body IS made of an open-porous dielectric is inserted into the flow path of the working gas, between the components of the gas feed system that lie at mass potential, for example the gas feed line GL, and the anode arrangement, which body is preferably structured as an open-pored ceramic body. The insulator body is configured in disk shape, as shown in an advantageous embodiment, and is oriented with the disk plane crosswise to the main flow direction through the insulator body between a gas entry surface EF and a gas exit surface AF. The main flow direction through the insulator body runs parallel to the longitudinal direction LR in the example shown. The disk plane of the insulator body lies parallel to the components anode electrode and anode carrier body of the anode arrangement, which are advantageously also disk-shaped. Between anode carrier body AT and insulator body IS, a gas-conducting aperture arrangement GB is advantageously inserted, which is preferably metallic and lies at anode potential, with high voltage relative to mass.

The insulator body is dielectrically resistant for the high voltage that occurs in operation of the drive arrangement. In operation of the arrangement, essentially the high-voltage potential HV of the anode arrangement quickly occurs at the gas exit surface AF, and essentially the mass potential M occurs at the gas entry surface EF, so that the gas-filled volumes VM between gas feed line GL and gas entry surface EF of the insulator, which lie at mass potential, and VA between the anode arrangement and the gas exit opening AF, respectively, are essentially field-free, and no corona discharges occur in these volumes VM, VA.

The insulator body advantageously possesses no continuous open structures in a straight line between the gas entry surface EF and the gas exit surface. The flow paths of the working gas between gas entry surface and gas exit surface are deflected, relative to a straight progression, and are particularly formed by pore cavities that are connected with one another and distributed within the insulator body, and generally branched. The average dimension of such pore cavities in the direction perpendicular to gas entry surface and gas exit surface is advantageously less than 100 μm. The pore size in the direction parallel to gas entry surface and gas exit surface and thus essentially crosswise to the direction of the field resulting from the high voltage is of lesser importance in comparison, so that insulator bodies made of fibrous material, for example, having a fiber direction crosswise to the electrical field direction can also be used. The average dimension of such cavities in a direction perpendicular to gas entry surface and gas exit surface is advantageously smaller than the Debye length, which results from known formulas at the given operating parameters, particularly at the known maximal pressure of the working gas, which typically lies on the order of 30-150 mbar on the side of the gas entry surface EF and below 1 mbar on the gas exit side, for example.

The smallest crosswise dimension of the insulator body in the disk plane is greater than the distance of the gas exit surface from the anode arrangement and/or of the gas entry surface from the gas feed line, in an advantageous embodiment, so that a small construction length in the flow direction of the working gas can be implemented. The insulator body is disposed in an insulator body arrangement with one or more essentially gastight insulator bodies KK, which are directly or indirectly mechanically connected with the chamber wall, in a manner shown schematically. The insulator body IS fills the entire cross-section of the gas feed system in the arrangement of the insulator body KK, so that no path that leads past the insulator body exists, by way of which a corona discharge, a plasma propagation, or some other current-conducting path could occur.

In FIG. 2, a use of a high-voltage insulator arrangement having a gas-permeable, open-porous insulator body on a plug connection as a component conducting high voltage is shown. In the plug connection SV, let two line sections K1, K2 be connected with one another to conduct current, in order to pass electrical power from a high-voltage source at high-voltage potential HV to an electrode such as the anode arrangement AN according to FIG. 1, for example. The two line sections K1, K2 have an inner conductor L1 or L2, respectively, and an insulating mantle M1 or M2, respectively, in each instance. In particular, the line section K1 can be a flexible cable that comes from a high-voltage source, and the line section K2 can be a connector piece on an ion accelerator drive module. The insulating mantle M1 can then be a flexible cable mantle, for example, made of PTFE, for example, and also, the insulating mantle M1 can be a tube made of insulating material, for example.

The plug connection (or another connection that can be released in destruction-free manner) advantageously allows destruction-free release of the electrical connection of the two inner conductors, thereby making it possible, for example, to produce the connection for a testing phase of a drive arrangement, separate it during installation of drive arrangement and high-voltage source into a spacecraft, and then join it together again, whereby the high-voltage-carrying plug connection must be dielectrically resistant with regard to components that lie at mass potential, also during the testing phase.

The plug connection is surrounded by an insulation device IV that extends in the longitudinal direction LL of the two conductors, by way of their insulating mantles M1, M2, and surrounds the plug connection on all sides. When high voltage from the high-voltage source is applied to the inner conductors, a vacuum is generally present outside of the insulation device. Within the insulating device, in the cavity HO around the exposed plug connection, gas can still be present from the installation, for one thing, or it can enter into the space around the plug connection even after an extended period of time, particularly from the boundary layer between inner conductors L1, L2 and insulating mantles M1, M2. Gas in the cavity around the plug connection can lead to the formation of plasmas in the cavity, which can also damage the insulating device over an extended period of time. The insulating device is sealed with regard to the cable mantles M1, M2, to such an extent that no plasma that might occur in the cavity HO can penetrate at the connection locations and bring about a flashover to the mass potential M. At least a part of the wall of the insulating device that delimits the cavity HO around the plug connection is formed by a gas-permeable, open-porous insulator body VK, which, having comparable properties as the insulator body IS from the example according to FIG. 1, allows gas to escape from the cavity HO into the surrounding vacuum, but prevents a plasma that might occur in the cavity from flashing over to a conductive component that lies at mass potential outside of the cavity. If, during operation of a device that contains the high-voltage insulator arrangement shown in FIG. 2, for example an ion accelerator drive of a spacecraft in space, is impacted by a gas surge, for example from a gas bubble between an inner conductor and an insulating mantle, in the cavity HO, then a plasma can form there, but this cannot penetrate to the outside through the insulator body VK, and is quickly extinguished again because the gas escapes to the outside through the open-porous insulator body. In contrast to this, in the case of a gastight encasing of the plug connection with an insulating casting material, a plasma ignited in the encasing could burn for a longer period of time if gas occurs in the region of the plug connection, and/or could ignite again and again, and might, under some circumstances, expose a path in the direction of a component that lies at mass, which path is permeable for plasma. The gas escaping to the outside through the insulator body does not reach the critical pressure required for formation of a plasma or a corona discharge, outside of the insulation device IV.

In the case of gas amounts that enter into the cavity HO from the conductors K1, K2 that are only very small, no plasma occurs in the cavity in the first place, since a critical minimum pressure is not reached, and an accumulation of multiple very small gas amounts does not take place, because of the gas permeability of the insulator body.

FIG. 3 shows a high-voltage insulator arrangement in a modification of the example according to FIG. 2. Here, a tubular insulator body IR directly surrounds the inner conductor L32 of a non-flexible line section K32, and continues all the way over the insulating mantle M1 of the line section K1, which shall be assumed to be the same as in FIG. 2. The insulator body can once again be surrounded by an outer tube AR, which can also be conductive and can lie at mass potential. An end cap EK can be set onto the end of the insulator body IR that surrounds the insulating mantle M11 and can be braced against the outer tube. AR in the longitudinal direction, if it is guaranteed that for one thing, gas can escape out of the cavity around the plug connection through the insulator body, into the surrounding vacuum VA, and for another, no path for a plasma exists from the cavity toward the outside, into the vacuum, or to a conductive component.

Since, in the case of high-voltage insulator arrangements according to the type of the examples in FIG. 2 and FIG. 3, a gas pressure that briefly occurs in the cavity and is sufficient for the formation of a plasma in the cavity typically lies clearly below the pressure of the working gas and in the insulator body IS in the exemplary embodiment according to FIG. 1, and thus the electron density in such a plasma is also lower, the Debye length in arrangements according to FIG. 2 and FIG. 3 is typically greater than in the example according to FIG. 1, so that in the case of orientation of the average pore size of the open-porous dielectric for applications according to FIG. 2 or FIG. 3, a greater value can be tolerated than in the example according to FIG. 1.

For the case that a gas pressure in the intermediate-pressure range occurs outside the cavity of the high-voltage insulator arrangement according to FIG. 2 or FIG. 3, a plasma can ignite both within and outside the cavity, if the ignition conditions are fulfilled. However, the plasmas cannot penetrate the porous insulator body, so that no continuous direct-current path can be built up between the components. After the intermediate-pressure range has dropped away, particularly after a vacuum has been set around the high-voltage insulator arrangement, the insulation function that was already described exists again.

The characteristics indicated above and in the claims, as well as those that can be derived from the figures, can advantageously be implemented both individually and in various combinations. The invention is not restricted to the exemplary embodiments described, but rather can be modified in many different ways, within the scope of the actions of a person skilled in the art.

The invention claimed is:

1. High-voltage insulator arrangement having a first (SV) and a second (M) conductive component, between which a high voltage can be applied, and which are separated by means of a space through which the electrical field of the high voltage passes, which can contain gas, at least part of the time, and having an insulation device (IV) that insulates the two conductive components with regard to one another, in the space, wherein the insulation device is formed at least in part by an insulator body (VK, IR) composed of an open-porous, gas-permeable dielectric, wherein the first of the two conductive components is formed by an anode electrode and conductive elements of an electrostatic ion accelerator arrangement connected with it, wherein the second of the two conductive components is formed by parts of a gas feed system, by way of which a working as can be introduced into an ionization chamber of the ion accelerator arrangement, wherein the insulator body has the working gas flowing through it and fills the cross-section of the flow path; and wherein the insulator body has a disk plane that is disposed parallel to the anode electrode.

2. Arrangement according to claim 1, further comprising a porous ceramic as an open-porous dielectric.

3. Arrangement according to claim 2, wherein gas-guiding paths through the insulator body are deflected with regard to a straight progression.

4. Arrangement according to claim 1, wherein pore cavities in the insulator body are shorter than the Debye length in a direction parallel to the field direction of the electrical field brought about by the high voltage.

5. Arrangement according to claim 1, wherein the insulator device (IV) encloses one of the conductive components (SV) in itself.

6. Arrangement according to claim 1, wherein the average pore size of the open-porous dielectric lies below 100 μm.

7. Arrangement according to claim 1, wherein one of the conductor components (SV) comprises a conductor contact location, particularly one that can be released.

8. Arrangement according to claim 1, wherein the anode electrode (AE) is disposed at the foot of the ionization chamber (IK), opposite a beam exit opening (AO), and wherein the insulator body (IS) is disposed on the side of the anode electrode that faces away from the ionization chamber (IK).

9. Arrangement according to claim 8, wherein a surface of the insulator body that faces the anode electrode has a distance from a metallic surface that lies at the potential of the anode, in the direction of the anode electrode, which distance is less than the dimensions of the insulator body crosswise to this direction.

10. Arrangement according to claim 1, wherein the insulator body is configured in disk shape and wherein the average gas flow direction through the insulator body runs perpendicular to the disk surface.

11. Use of a high-voltage insulator arrangement according to claim 1 in an electrostatic ion accelerator arrangement having an ionization chamber (IK) and an anode electrode (AE) disposed in the ionization chamber as a first conductive component, as well as a gas feed system (GV, GL, GQ) for introducing working gas (AG) into the ionization chamber, and a field that passes through the ionization chamber and accelerates electrostatically positively charged ions in the direction of a beam exit opening, whereby the anode electrode (AE) lies at a high voltage (HV) with regard to a second conductive component (GL, GV, GQ) situated upstream in the gas feed system, whereby a gas-permeable insulator body (IS) composed of an open-porous dielectric is disposed in the flow path of the gas feed system, and the working gas (AG) flows through the insulator body to the ionization chamber (IK), and the anode electrode and conductive components that lie on its potential lie completely downstream of the insulator body, in the flow path of the working gas.

* * * * *

UNITED STATES PATENT AND TRADEMARK OFFICE

CERTIFICATE OF CORRECTION

PATENT NO. : 8,587,202 B2
APPLICATION NO. : 12/733628
DATED : November 19, 2013
INVENTOR(S) : Harmann et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 920 days.

Signed and Sealed this
Twenty-second Day of September, 2015

Michelle K. Lee

Michelle K. Lee
*Director of the United States Patent and Trademark Office*